US011039717B2

(12) United States Patent
Romero

(10) Patent No.: US 11,039,717 B2
(45) Date of Patent: Jun. 22, 2021

(54) DETACHABLE GUIDE ASSEMBLY FOR A SHOWER ENCLOSURE DOOR

(71) Applicant: Kohler Mira Limited, Cheltenham (GB)

(72) Inventor: Jose Luis Beltran Romero, Cheltenham (GB)

(73) Assignee: KOHLER MIRA LIMITED

( * ) Notice: Subject to any disclaimer, the term of this patent is extended or adjusted under 35 U.S.C. 154(b) by 3 days.

(21) Appl. No.: 16/534,489

(22) Filed: Aug. 7, 2019

(65) Prior Publication Data

US 2019/0357733 A1 Nov. 28, 2019

Related U.S. Application Data

(63) Continuation of application No. PCT/GB2018/050105, filed on Jan. 16, 2018.

(30) Foreign Application Priority Data

Feb. 8, 2017 (GB) ..... 1702042

(51) Int. Cl.
*A47K 3/34* (2006.01)
*E05D 15/06* (2006.01)

(52) U.S. Cl.
CPC ..... *A47K 3/34* (2013.01); *E05D 15/0656* (2013.01); *E05Y 2600/52* (2013.01); *E05Y 2600/528* (2013.01); *E05Y 2900/114* (2013.01)

(58) Field of Classification Search
CPC ..... A47K 3/34; A47K 3/362
USPC ..... 4/607, 605, 557; 49/381
See application file for complete search history.

(56) References Cited

FOREIGN PATENT DOCUMENTS

| | | |
|---|---|---|
| DE | 29711352 | 9/1997 |
| DE | 202006005607 | 6/2006 |
| DE | 202009005076 | 12/2010 |
| EP | 1 488 725 | 12/2004 |
| EP | 3 095 365 | 11/2016 |

OTHER PUBLICATIONS

International Search Report and Written Opinion re PCT/GB2018/050105; 9 pgs.
Combined Search and Examination Report GB Patent Application No. 1800662.7 dated Jul. 13, 2018; 8 pages.

*Primary Examiner* — Lori L Baker
(74) *Attorney, Agent, or Firm* — Foley & Lardner LLP

(57) ABSTRACT

A detachable guide assembly for a shower enclosure door includes a frame member defining a boundary of the shower enclosure, a guide member arranged to receive a shower enclosure door and guide sliding movement of the shower enclosure door relative to the frame member. The guide member is detachably fixed to the frame member, and an actuator is operable to detach the guide member from the frame member. The actuator is operable from outside of the shower enclosure.

18 Claims, 4 Drawing Sheets

DETACHABLE GUIDE ASSEMBLY FOR A SHOWER ENCLOSURE DOOR

CROSS-REFERENCE TO RELATED PATENT APPLICATIONS

The present application is a Continuation of International Application No. PCT/GB2018/050105, filed Jan. 16, 2018, which claims priority to and the benefit of United Kingdom Patent Application No. GB 1702042.1, filed Feb. 8, 2017. The entire disclosures of each of the foregoing applications are incorporated by reference herein.

BACKGROUND

The present application relates to a detachable guide assembly for a shower enclosure door. In particular, the present application relates to a detachable guide for a slidable shower door.

A shower door may be coupled to the frame of a shower enclosure such that it slides along the frame. Various coupling mechanisms are known to allow the door to slide in this way. For example, the door may be provided with a wheel or bearing arrangement that runs along a track in the frame to allow the door to slide open and closed. In other examples, the frame may comprise a fixed guide to receive the door, the fixed guide arranged to allow the door to slide relative to the frame.

With the sliding door coupled to the frame in this way, it may be difficult to effectively clean the shower enclosure. In particular, the user may find it difficult to clean parts of the shower enclosure that are blocked or are difficult to reach because of the position of the door and coupling to the frame. For example, the door may obstruct access to parts of the shower enclosure such as the inside edge of the frame adjacent the door. The coupling mechanism itself may also be difficult to clean.

Some prior art shower enclosures provide a mechanism that allows a sliding door to be detached from the frame relative to which it slides. The prior art mechanisms may be difficult to install and do not allow simple replacement of parts and components. For example, the prior art mechanisms are often difficult to locate and access by the user when installing the shower enclosure, or when the user is cleaning the shower. They do not provide an adequate solution to the problem of allowing easy cleaning or installation as they do not allow the user or installer to quickly and easily slidably couple the shower door to the frame and to detach the shower door again from outside if the shower enclosure.

SUMMARY

An exemplary embodiment relates to a detachable guide assembly for a shower enclosure door that includes a frame member defining a boundary of a shower enclosure and a guide member arranged to receive a shower enclosure door and guide sliding movement of the shower enclosure door relative to the frame member. The guide member is detachably fixed to the frame member. The detachable guide assembly also includes an actuator operable to detach the guide member from the frame member. The actuator is operable from outside of the shower enclosure.

BRIEF DESCRIPTION OF THE DRAWINGS

Embodiments of the invention will now be described, by way of example only, with reference to the accompanying drawings, in which.

DETAILED DESCRIPTION

Figure 1:
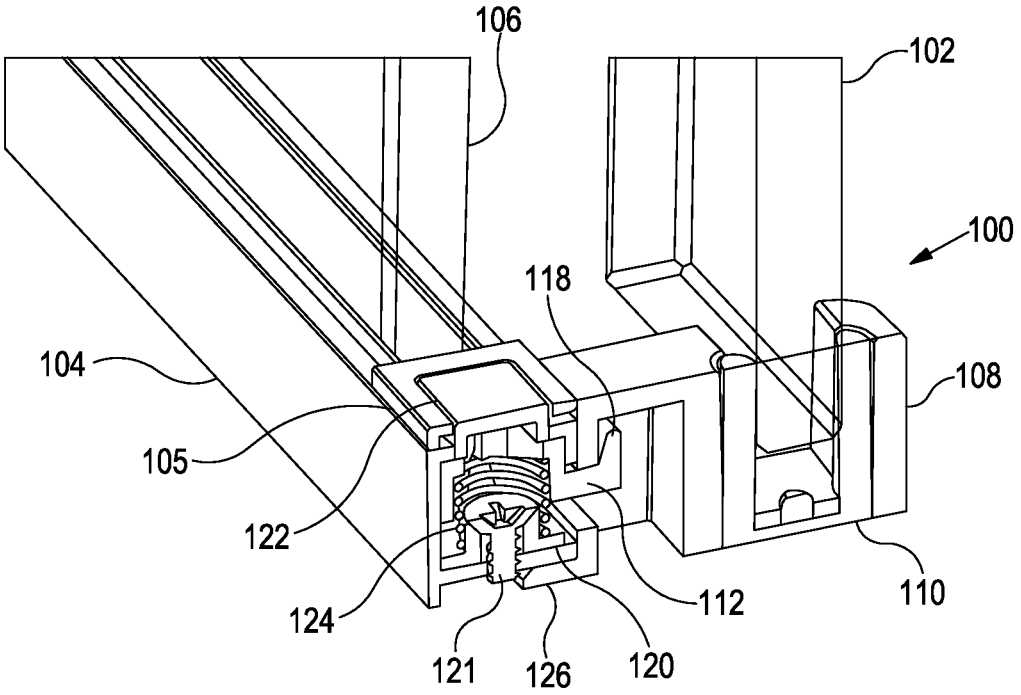
FIG. 1 shows a cross-section view through a removable guide assembly according to an embodiment.

In one aspect, the present invention provides a detachable guide assembly for a shower enclosure door, comprising: a frame member defining a boundary of the shower enclosure; a guide member arranged to receive a shower enclosure door and guide sliding movement of the shower enclosure door relative to the frame member, the guide member being detachably fixed to the frame member; and an actuator operable to detach the guide member from the frame member, wherein the actuator is operable from outside of the shower enclosure.

By providing a detachable guide member which may slidably receive the shower door, the installation of the shower enclosure may be made easier. For example, during installation, the guide member may be coupled to the shower enclosure door after the door has been attached to an upper frame member. For example, the shower door may be attached, by hanging, to an upper frame member. The shower door can then be conveniently left to hang. When the installer is ready to attach the guide member, the bottom of the door can be easily tilted away from the (lower) frame member, and the guide member slotted into its desired position. The guide member may therefore be conveniently coupled to the shower door, and then the guide member coupled to the frame member via the actuator. Furthermore, by allowing the user to operate the actuator from outside of the shower enclosure, they can easily detach the guide member from the frame member. The door may therefore be detached without having to enter the shower enclosure or reach around the door to access a hard to reach actuator. The user may therefore quickly and easily move the shower door away from the frame. This then allows easy access to the frame member and other parts of the shower enclosure, making cleaning of the shower easier.

Optionally, the actuator is movable between a first state in which the guide member is attached in a stationary manner to the frame member and a second state in which the guide member is unattached from the frame member.

Optionally, the actuator is at least partly disposed between the shower enclosure door and the outside of the shower enclosure. In this arrangement, the shower enclosure door does not block access to the actuator, which may allow it to be more easily accessed from outside of the shower enclosure.

Optionally, at least part of the actuator is disposed on an upper surface of the frame member or an upper surface of the guide member. This may also provide easy access.

Optionally, a downward motion of at least part of the actuator detaches the guide member from the frame member. This may make it easier for the user to operate the actuator.

Optionally, the guide member is detachably fixed to a side of the frame member adjacent to the interior of the shower enclosure. In this arrangement, the shower enclosure door is less likely to block access to the actuator.

Optionally, the actuator is operable from outside of the shower enclosure when the shower enclosure door is in a closed position. Optionally, the actuator may be operable from outside the shower enclosure when the shower enclosure door is in an open position and is partly overlapped with a fixed enclosure panel of the shower enclosure.

Optionally, the actuator comprises a hook member movable during operation of the actuator, the hook member arranged to engage with an aperture in the frame member, an aperture in the guide member, or both, to detachably fix the guide member to the frame member. This may provide a quick and efficient coupling between the guide member and the frame member.

Optionally, the actuator further comprises a hook guide arranged to guide movement of the hook member. This may help control movement of the hook member.

Optionally, the actuator comprises a cover member coupled to the hook member, the cover member adapted to be operated by the user in order to detach the guide member.

Optionally, the cover member has a surface arranged generally level with a top surface of the frame member. The cover member may provide a smooth or continuous finish and may allow easy cleaning of the guide assembly.

Optionally, the cover member forms a push button. This may be conveniently pushed by the user to detach the guide member.

Optionally, the actuator comprises a biasing member arranged to bias the actuator towards a position in which the guide member is fixed to the frame member. This may keep the shower enclosure door and frame member fixed together until detached by the user.

Optionally, the removable guide assembly further comprises a locating member on the guide member or on the frame member, the locating member arranged to engage with the other of the frame member or the guide member to detachably fix the guide member to the frame member. This may provide a second point of contact between the guide member and the frame member and may aid the attachment between them.

Optionally, the actuator is disposed substantially within the frame member. This may allow the actuator to be fitted to an existing frame member and may help to keep the guide assembly clean and the actuator out of sight.

Optionally, the shower enclosure door is free to move away from the frame member toward the interior of the shower enclosure when the guide member is detached from the frame member. This may allow the user to access parts of the shower enclosure that would otherwise be blocked by the shower enclosure door.

Optionally, the frame member is a lower frame member and the guide member is arranged to receive a lower portion of the shower enclosure door, and wherein the removable guide assembly further comprises an upper frame member and a sliding mechanism arranged to slidably couple an upper portion of the shower enclosure door to the upper frame member, wherein the sliding mechanism is arranged to allow movement of the shower enclosure door away from the lower frame member.

Optionally, the sliding mechanism is arranged to allow pivoting of the shower enclosure door away from the lower frame member.

Optionally, the sliding mechanism comprises a limiting means arranged to limit the extent of the movement of the shower enclosure door away from the lower frame member. This may allow the shower enclosure door to be moved or pivoted away from the lower frame member whilst not allowing decoupling of the shower enclosure door from the upper frame member.

Optionally, the guide member comprises a low friction member arranged to allow relative sliding between the guide member and the shower enclosure door. This may help the shower enclosure door slide relative to the frame member.

Optionally, the frame member is further arranged to receive a fixed enclosure panel, and wherein the frame member is arranged such that the shower enclosure door received in the guide member is arranged to slide parallel to the fixed enclosure panel.

Figure 2:
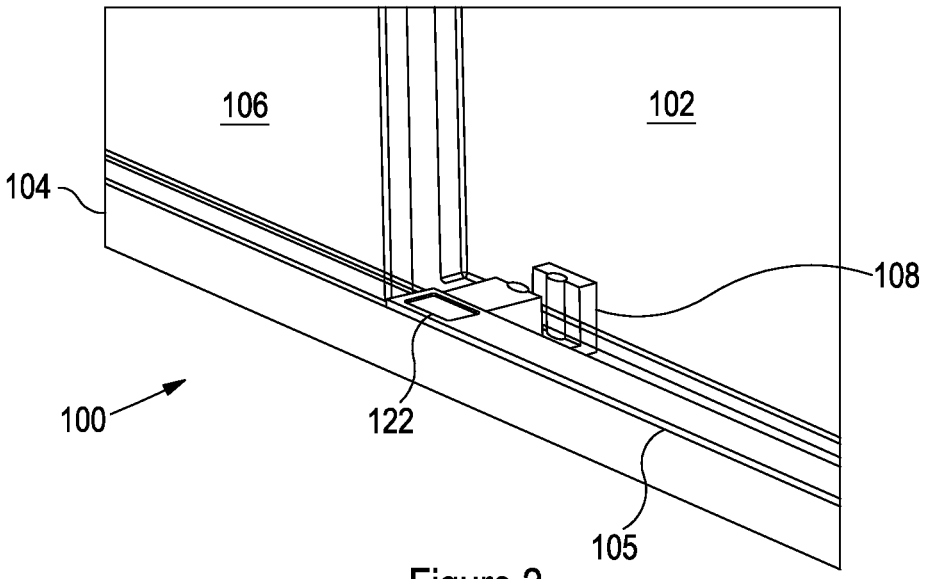
FIG. 2 shows a perspective view of a removable guide assembly according to an embodiment.

Turning now to the accompanying drawings, a detachable guide assembly 100 is shown in FIGS. 1 to 4. The detachable guide assembly 100 comprises a frame member 104 defining a boundary of the shower enclosure. As can be seen in FIG. 2, the frame member 104 may define a boundary between the inside and outside of the shower enclosure. In the described embodiment, the shower enclosure further comprises a fixed enclosure panel 106 that is received in, and fixed relative to, the frame member 104. In some embodiments, the shower enclosure may be made up of other sliding doors and panels associated with the frame member 104. In yet other embodiments, additional frame members and associated doors and panels may also be provided. The shower enclosure may be any enclosure in which a shower is located—it may for example be a shower cubicle, or may be a bathtub or any other type of bathing enclosure with a shower.

The frame member 104 may be formed by an elongate open track adapted to receive the fixed enclosure panel 106. At a section of the frame member 104 where there is no fixed panel, (e.g. alongside the enclosure door 102) a frame cap 105 may be provided to close the open top of the frame member 104 and form a top surface of the frame member 104 (e.g. to form an infill channel). In other embodiments, this section of the frame member 104 may be formed by a closed tubular member with no frame cap. In yet other embodiments, any other suitable shape frame member may be provided and coupled to the fixed enclosure panel 106 by any suitable means known in the art.

The guide assembly 100 further comprises a guide member 108. The guide member 108 is arranged to receive the shower enclosure door 102 and guide its sliding movement relative to the frame member 104. This allows the enclosure door 102 to be opened and closed using a sliding movement to allow access to the shower enclosure. In the described embodiment, the guide member 108 comprises a body having a slot or a recess arranged to receive an edge of the enclosure door 102. The shower enclosure door 102 may, for example, be slidably coupled to the guide member 108 by a push fit or friction fit coupling. This may allow the shower enclosure door 102 to be conveniently slotted into the recess during installation to provide the sliding coupling between them. The guide member 108 may facilitate sliding motion along the frame member 104, but may prevent the enclosure door 102 from moving away from the frame member 104. The guide member 108 may be attached to the frame member 104 such that the sliding enclosure door 102 is arranged to slide parallel to the fixed enclosure panel 106. In other embodiments, any other suitable guide member arrangement may be provided to facilitate sliding motion of the enclosure door 102.

The guide member 108 may comprise a low friction member 110 arranged to allow relative sliding between the guide member 108 and the enclosure door 102. The low friction member 110 may comprise a low friction insert, as shown in the Figures, which may be formed of a material that reduces friction between the guide member 108 and the enclosure door 102. In other embodiments, the low friction member 110 may comprise one or more rollers or bearings or the like adapted to allow sliding of the enclosure door 102 relative to the frame member 104.

The guide member 108 is detachably fixed to the frame member 104. When fixed to the frame member 104, the guide member 108 is in a stationary position relative to the frame member 104. Conversely, when the guide member 108 is detached from the frame member 104, the enclosure door 102 is free to move away from the frame member 104 and may, for example move toward the interior of the shower enclosure. In other embodiments, it may swing away from the interior of the shower enclosure, or it may pivot to allow access.

The guide assembly 100 further comprises an actuator operable to detach the guide member 108 from the frame member 104. By operating the actuator, the user may detach the guide member 108 from stationary engagement with the frame member 104. The actuator is therefore movable between a first state in which the guide member 108 is attached in a stationary manner to the frame member 104 and a second state in which the guide member 108 is unattached from the frame member 104.

The actuator is operable from outside of the shower enclosure. This means that the user can easily detach the guide member 108 from the frame member 104 whilst outside of the shower enclosure. By providing quick and easy access to the actuator the cleaning process may be simplified. Once detached, the guide member 108 (and hence the enclosure door 102 to which it is attached) can be moved away from the frame member 104. This may facilitate easy cleaning of the guide assembly 100 or other parts of the shower enclosure. For example, the user may more easily clean an inside surface of the frame member 104 (e.g. a surface adjacent to the interior of the enclosure) or the floor of the enclosure around the guide member 108. Furthermore, by operating the actuator from outside of the shower enclosure the shower enclosure may be more easily installed. For example, when installing the enclosure door 102, the installer may engage the actuator from outside of the shower enclosure, rather than having to locate and reach an actuator positioned inside the shower enclosure. The guide assembly 100 therefore offers a very quick and easy method of installation.

The guide member 108 may provide one point of attachment between the enclosure door 102 and the frame member 104. In some embodiments, one or more further guide members may be provided to detachably fix the enclosure door 102 to the frame member 104. In other embodiments, one or more non-detachable guide members or other suitable sliding attachment mechanisms may be provided to further attach the enclosure door 102 to the frame member 104. For example, one or more detachable guide members may be provided at the bottom of the enclosure panel, with one or more non-detachable guide members being provided at the top of the enclosure panel.

The frame member 104 may form at least part of a lower frame of the shower enclosure as shown in the Figures. The frame member 104 may, for example, be a lower frame member adapted to couple to the lower part of the enclosure door (and any other panels and doors making up the enclosure). An upper frame member (not shown in the Figures) may also be provided to attach to the upper part of the enclosure door 102 (or other panels and doors that may be present). The enclosure door 102 may be suspended from the upper frame member using a suitable sliding mechanism. The sliding mechanism used to attach the shower enclosure door to the upper frame member may allow the bottom of the enclosure door 102 to move away from the lower frame member when not attached by the detachable guide member 108. The sliding mechanism may, for example, allow the bottom of the enclosure door 102 to pivot or swing in a direction away from the frame member 104.

In some embodiments, the sliding mechanism is arranged to allow pivoting of the shower enclosure door so that it may move away from the lower frame member. The sliding mechanism may further comprise a limiting means arranged to limit the extent of the movement of the shower enclosure door 102 away from the lower frame member. This may allow a desired degree of separation between the shower enclosure door 102 and the lower frame member (to provide easy installation and/or cleaning access), whilst ensuring that the shower enclosure door 102 does not become disconnected from the upper shower member.

By providing a guide assembly 100 having a guide member 108 which is detachably coupled to the frame member 104 the shower enclosure may be easier to install. For example, during installation, the guide member 108 may be slidably coupled to the shower enclosure door 102 once the door has been coupled to the upper frame member. The guide member 108 may then be fixed to the frame member 104 and held in place by the actuator. Furthermore, the actuator is advantageously positioned such that it may be operated by the user from outside of the shower enclosure. In the described embodiment, the actuator is disposed between the enclosure door 102 and the outside of the shower enclosure. The guide assembly 100 may be coupled to the frame member 104 at a point spaced from the fixed enclosure panel 106 along the length of the frame member 104. As can be seen in FIG. 2, the guide assembly 100 is coupled to the frame member 104 at a point spaced apart from an edge of the fixed enclosure panel 106 in a direction along the length of the frame member 104. The actuator is correspondingly positioned so that it is also spaced apart from the edge of the fixed enclosure panel 106 in a direction along the length of the frame member 104. The actuator may be positioned so that it is at least partly in the same plane as the fixed enclosure panel 106, but spaced apart from its edge so that they do not overlap as shown in FIG. 2. This means that the actuator can be more easily accessed by the user from outside of the shower enclosure without the shower enclosure door 102 or fixed enclosure panel 106 blocking access (e.g. if the actuator was located on the other side of the shower door 102, or if the fixed enclosure panel 106 overlapped with the actuator). In other embodiments, part of the actuator may extend past the enclosure door 102, with at least part of the actuator remaining between the enclosure door 102 and the outside of the enclosure door to aid access.

At least part of the actuator may be disposed on an upper surface of the frame member 104 (or an upper surface of the guide member 108 if the actuator is located in the guide member). As can be seen in the Figures, the part of the actuator to be operated (e.g. pushed) by the user may be located on the top surface of the frame member 104. This may allow it to be easily accessed by the user from outside of the shower enclosure. In other embodiments, this part of the actuator may be positioned on the outside edge of the frame member 104 adjacent to the outside of the shower enclosure.

The guide member 108 may be detachably fixed to a side of the frame member 104 adjacent to the interior of the shower enclosure (e.g. to an inside wall of the frame member 104). The guide member 108 may therefore extend away from the frame member 104 into the shower enclosure to provide space to access the actuator from outside of the shower enclosure. In some embodiments, the combination of the position of the actuator on top of the frame member 104, and the position of the guide member 108 extending from the inside wall of the frame member 104 may provide quick and convenient access for the user to detach the shower door for cleaning.

In the described embodiment, a downward motion of at least part of the actuator may detach the guide member 108 from the frame member 104. The user may therefore push downwards on the actuator to operate it. This may make it easier for the user to detach the guide member 108 and the sliding enclosure door 102 from outside of the shower enclosure. In other embodiments, a different actuator arrangement may be provided in which a sideways movement (and hence sideways force applied by the user), or other suitable movement, may be required to detach the guide member 108.

Figure 3:
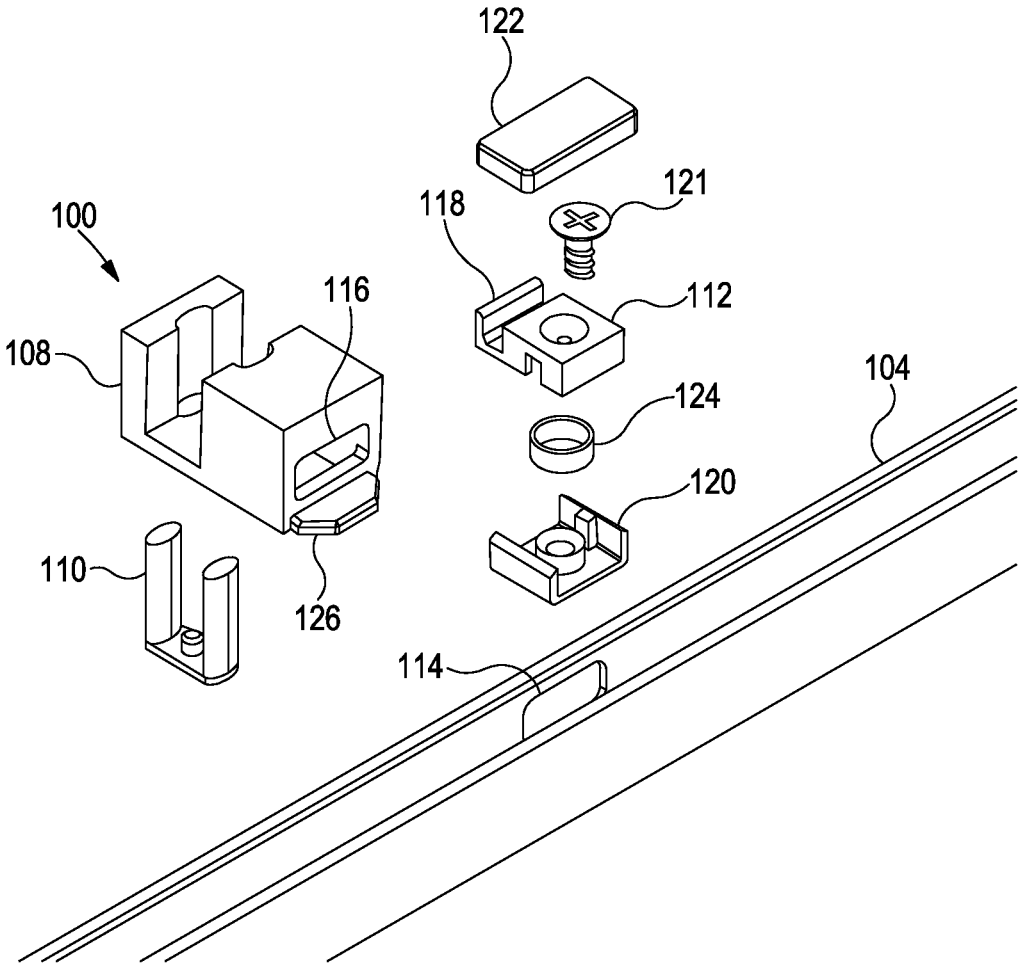
FIG. 3 shows an exploded view of a removable guide assembly according to an embodiment.
Figure 4:
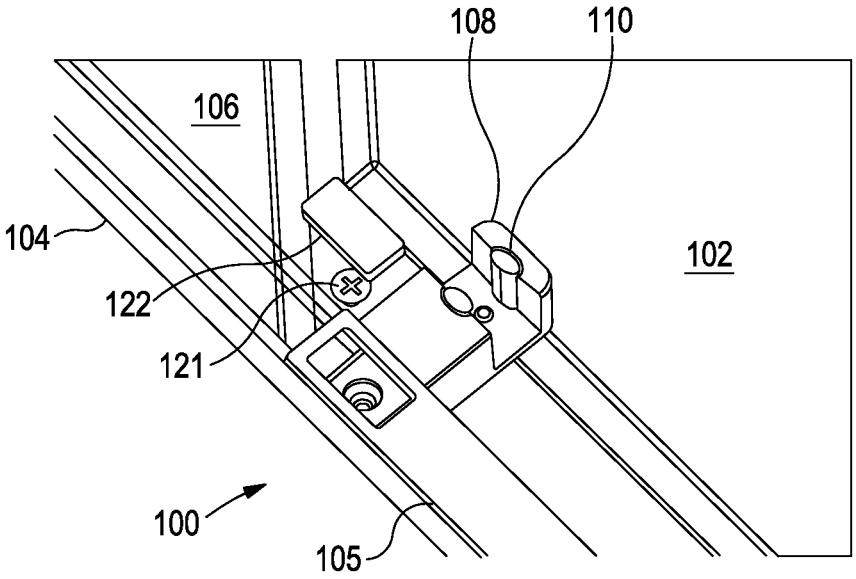
FIG. 4 shows another exploded view of a removable guide assembly according to an embodiment.

An example of an actuator according to one embodiment of the guide assembly 100 is shown in the exploded views of FIG. 3 and FIG. 4. In this embodiment, the actuator is provided as part of the frame member 104, and detachably fixes to the guide member 108. In the described embodiment, the actuator is formed by a mechanical actuator mechanism located substantially within the frame member 104. For example, the actuator may be arranged within a track formed within the frame member 104 or within a body of the frame member 104. This may allow the actuator to be conveniently fitted to existing frame members and kept out of sight.

The actuator may comprise a hook member 112 arranged to detachably fix the guide member 108 to the frame member 104. In the described embodiment, the hook member 112 may be arranged to pass through an aperture 114 in the frame member 104 to engage with a corresponding aperture 116 in the guide member 108. The hook member 112 may be shaped to engage with the aperture 116 in the guide member 108 to fix it to the frame member 104. For example, the hook member 112 may comprise a lip 118 adapted to hook around the wall of the guide member 108 surrounding the aperture 116. In other embodiments, the hook member 112 may be any other suitable shape so that it may releasably engage the guide member 108.

The guide member 108 may be detachably fixed to a side wall of the frame member 104 as shown in the Figures. In the described embodiment, the guide member 108 may be detachably fixed to the sidewall of the frame member 104 which is adjacent to the interior of the shower enclosure (e.g. an inside wall) as described above. In such an embodiment, the aperture 114 provided in the frame member 104 may be located in the inside wall of the frame member 104. This arrangement may allow the actuator and enclosure door 102 to be arranged such that the actuator is disposed between the sliding enclosure door 102 and the outside of the shower enclosure. This may help to facilitate easy access from outside of the shower enclosure.

The hook member 112 may be movable to detachably fix the guide member 108 to the frame member 104. The hook member 112 may be arranged to move between an attached position in which it is fixed to the guide member 108, and an unattached position in which it is not fixed to the guide member 108. In the described embodiment, the hook member 112 may be arranged to move downwards from the attached position to the unattached position. As described above, this may facilitate easy operation by the user.

The actuator may further comprise a hook guide 120 arranged to guide movement of the hook member 112. The hook guide 120 may comprise an insert having one or more protrusions adapted to engage with one or more indents on the hook member 112 to guide its movement. In other embodiments, the protrusions and indents may be reversed such that the indents are provided on the hook guide 120 and the protrusions on the hook member 112. The hook guide 120 may help to control the movement of the hook member 112.

In the described embodiment, the guide assembly 100 further comprises a removable fixing member 121 arranged to fix the hook member 112 and the hook guide 120 to the frame member 104. The removable fixing member 121 may comprise a screw or other suitable fixing means arranged to couple to a lower surface of the frame member 104 as shown in FIG. 1. The fixing member 121 may, for example, screw into a hole with corresponding screw threads in the lower surface of the frame member 104. The removable fixing member may allow the components of the guide assembly 100 to be conveniently assembled and disassembled so that they can be easily serviced or replaced. Prior art systems do not allow for such easy replacement in configurations with easy access for installation and/or cleaning.

The actuator may further comprise a cover member 122 coupled to the hook member 112. The cover member 122 may be operated (e.g. pushed) by the user to detach the guide member 108. The cover member 122 may, for example, be formed by a push button that can be pressed by the user to operate the actuator.

The cover member 122 may be disposed on an upper surface of the frame member 104 (or on an upper surface of the guide member 108 where the actuator is provided in the guide member 108) so that it is easily accessible. In some embodiments, the top surface of the cover member 122 may lie generally level or flush with a top surface of the frame member 104 (or cover strip forming the top surface as shown in FIG. 2). This may make the detachable guide assembly 100 easier to clean and provide a uniform finish with the top of the frame member 104. In other embodiments, the cover member 122 may be formed as part of the hook member 112, rather than being a separate component as shown in the Figures. In such an embodiment, the hook member 112 may be pushed directly by the user in order to move it between the attached and unattached positions.

The actuator may further comprise a biasing member 124 arranged to bias the actuator towards a position in which the guide member 108 is fixed to the frame member 104. In the described embodiment, the biasing member 124 is arranged to bias the hook member 112 upwards towards its attached position. When the actuator is operated, the user applies a force adequate to overcome the action of the biasing member 124 so that the hook member 112 moves from the attached position to the unattached position. The biasing member 124 may comprise a coiled spring as shown in the Figures. The biasing member 124 may fit around the fixing member 121 to provide a compact arrangement as shown in the Figures. In other embodiments, any other suitable biasing member may be provided such as a leaf spring or the like.

Figure 5:
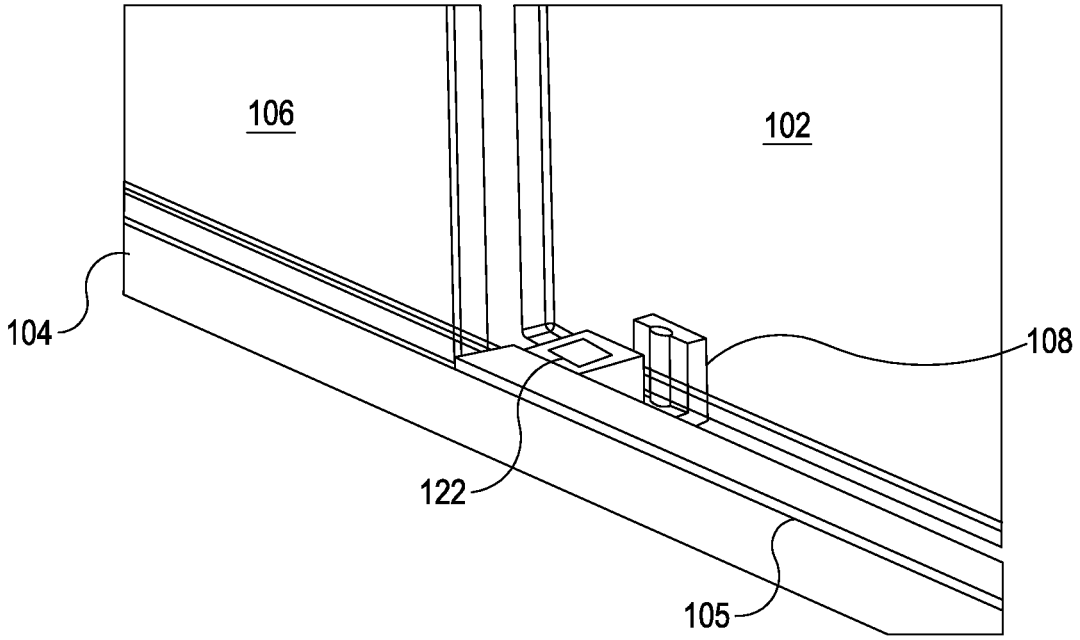
FIG. 5 shows a perspective view of another embodiment of the removable guide assembly.

The arrangement shown in the Figures is only one example of an actuator arrangement that may be used to detach the guide member 108 from the frame member 104. In other embodiments, the actuator may be disposed within a body of the guide member 108 rather than in the frame member 104. In such an embodiment, the actuator forms part of the guide member 108, and is detachably fixed to the frame member 104. In this embodiment, at least part of the actuator may be provided in a top surface of the guide member 108. For example, the cover member may form a push button disposed on the top surface of the guide member 108 as shown in FIG. 5.

The removable guide assembly 100 may further comprise a locating member 126 provided on the guide member 108. The locating member 126 may be formed by a lip or protrusion arranged to engage with a corresponding indent or aperture in the frame member 104 (not shown in the Figures). The locating member 126 may act to locate the position of the guide member 108 to detachably fix it to the frame member 104. It may, for example, form a second point of contact arranged to cooperate with the hook member 112 to aid alignment and fixing. In the described embodiment, the locating member 126 is provided on the guide member 108. In other embodiments, the locating member 126 may be provided on the frame member 104 and may be adapted to engage with a corresponding indent or aperture on the guide member 108.

In use, the guide assembly 100 may facilitate easy installation of the shower enclosure. During installation, the installer may first couple the shower enclosure door 102 to the upper frame of the shower enclosure. The shower enclosure door 102 may, for example, be coupled or hung by a sliding mechanism as described above. Once coupled in this may, the installer may attach the guide member 108 to the lower portion or edge of the shower enclosure door 102. For example, the shower enclosure door 102 may be positioned inside the slot or recess of the guide member 108 in which it may slide, and is then held by the friction fit between them. The guide member 108 (and hence the shower enclosure door 102) may then be fixed to the frame member 104. The guide member 108 may therefore be attached after the shower enclosure door 102 has been coupled to the upper frame member.

Furthermore, the actuator may be used to quickly and conveniently detach the guide member 108 from outside of the shower enclosure. For example, during cleaning of the shower enclosure, the user may operate the actuator from a position outside of the shower enclosure. The position of the actuator allows the door to be quickly and easily detached without having to enter the shower enclosure or reach around parts of the enclosure to access the actuator. Once the actuator has been operated, the user my move the guide member 108, and hence the enclosure door 102, away from the frame member 104. The user may, for example, swing the shower enclosure door 102 away from the frame member 104 towards the interior of the shower enclosure. The shower enclosure may then be cleaned. During cleaning, the separation of the guide member 108 and the frame member 104 may make access to parts of the shower enclosure easier. Once cleaning has been completed, the user may reattach the guide member 108 to the frame member 104. In other embodiments, the actuator may facilitate installation of the shower enclosure door 102. For example, once in position, the shower enclosure door may be coupled via the detachable guide member 108 by operation of the actuator from outside of the shower enclosure. The enclosure door 102 can then slide relative to the frame member 104 for normal operation of the shower enclosure.

Various modifications will be apparent to the skilled person without departing form the scope of the claims. For example, the actuator shown in the figures is only one example of a suitable actuator that may be used. Alternatively, another form of mechanical actuator may be provided to detachably fix the guide member 108 to the frame member 104. For example, an alternative mechanical linkage may be provided to move the hook member 112 to release the guide member 108. In other embodiments, the actuator may be another type of actuator rather than a mechanical actuator. In some embodiments, the actuator may be formed by an electronic actuator that can be triggered by an input switch accessible from outside if the shower enclosure.

What is claimed is:

1. A detachable guide assembly for a shower enclosure door, comprising:

a frame member defining a boundary of a shower enclosure;

a guide member arranged to receive a shower enclosure door and guide sliding movement of the shower enclosure door relative to the frame member, the guide member being detachably fixed to the frame member; and an actuator operable to detach the guide member from the frame member, wherein the actuator is movable between a first state in which the guide member is attached in a stationary manner to the frame member and a second state in which the guide member is unattached from the frame member, and wherein the actuator is at least partly disposed between the shower enclosure door and the outside of the shower enclosure such that it is operable from outside of the shower enclosure.

2. The detachable guide assembly of claim 1, wherein at least part of the actuator is disposed on an upper surface of the frame member or an upper surface of the guide member.

3. The detachable guide assembly of claim 2, wherein a downward motion of at least part of the actuator detaches the guide member from the frame member.

4. The detachable guide assembly of claim 1, wherein the guide member is detachably fixed to a side of the frame member adjacent to the interior of the shower enclosure.

5. The detachable guide assembly of claim 1, wherein the actuator is operable from outside of the shower enclosure when the shower enclosure door is in a closed position.

6. The detachable guide assembly of claim 1, wherein the actuator comprises a hook member movable during operation of the actuator, the hook member arranged to engage with at least one of an aperture in the frame member or an aperture in the guide member to detachably fix the guide member to the frame member.

7. The detachable guide assembly of claim 6, wherein the actuator further comprises a hook guide arranged to guide movement of the hook member.

8. The detachable guide assembly of claim 6, wherein the actuator comprises a cover member coupled to the hook member, the cover member adapted to be operated by the user in order to detach the guide member.

9. The detachable guide assembly of claim 8, wherein either or both of: (a) the cover member has a surface arranged generally level with a top surface of the frame member, and/or (b) the cover member forms a push button.

10. The detachable guide assembly of claim 1, wherein the actuator comprises a biasing member arranged to bias the actuator towards a position in which the guide member is fixed to the frame member.

11. The detachable guide assembly of claim 1, further comprising a locating member on the guide member or on the frame member, the locating member arranged to engage with the other of the frame member or the guide member to detachably fix the guide member to the frame member.

12. The detachable guide assembly of claim 1, wherein the actuator is disposed substantially within the frame member.

13. The detachable guide assembly of claim 1, wherein the shower enclosure door is free to move away from the frame member toward the interior of the shower enclosure when the guide member is detached from the frame member.

14. The detachable guide assembly of claim 13, wherein the frame member is a lower frame member and the guide member is arranged to receive a lower portion of the shower enclosure door, and wherein the removable guide assembly further comprises an upper frame member and a sliding mechanism arranged to slidably couple an upper portion of the shower enclosure door to the upper frame member, wherein the sliding mechanism is arranged to allow movement of the shower enclosure door away from the lower frame member.

15. The detachable guide assembly of claim 14, wherein either one or both of: (a) the sliding mechanism is arranged to allow pivoting of the shower enclosure door away from the lower frame member; and/or (b) the sliding mechanism comprises a limiting means arranged to limit the extent of the movement of the shower enclosure door away from the lower frame member.

16. The detachable guide assembly of claim 1, wherein the guide member comprises a low friction member arranged to allow relative sliding between the guide member and the shower enclosure door.

17. The detachable guide assembly of claim 1, wherein the frame member is further arranged to receive a fixed enclosure panel, and wherein the frame member is arranged such that the shower enclosure door received in the guide member is arranged to slide parallel to the fixed enclosure panel.

18. The detachable guide assembly of claim 17, wherein the actuator is arranged such that it is spaced apart from the fixed enclosure panel in a direction along the length of the frame member.

* * * * *